US005878146A

United States Patent [19]

Andersen

[11] Patent Number: 5,878,146

[45] Date of Patent: Mar. 2, 1999

[54] HEARING AID

[75] Inventor: Henning Haugaard Andersen, Hørsholm, Denmark

[73] Assignee: Tøpholm & Westermann ApS, Vaerloese, Denmark

[21] Appl. No.: 836,260

[22] PCT Filed: May 29, 1995

[86] PCT No.: PCT/EP95/02033

§ 371 Date: May 9, 1997

§ 102(e) Date: May 9, 1997

[87] PCT Pub. No.: WO96/17493

PCT Pub. Date: Jun. 6, 1996

[30] Foreign Application Priority Data

Nov. 26, 1994 [DE] Germany ..... 44 41 996.1

[51] Int. Cl.[6] ..... H04R 25/00

[52] U.S. Cl. ..... 381/312; 381/318; 381/320

[58] Field of Search ..... 381/23.1, 60, 68, 381/68.2, 68.4, 68.6, 68.7, 68.3, 68.5, 312, 314, 317, 318, 320, 321, 323

[56] References Cited

U.S. PATENT DOCUMENTS 4,471,171 9/1984 Kopke et al. ..... 381/60

5,276,739 1/1994 Krokstad et al. ..... 381/68.2

FOREIGN PATENT DOCUMENTS 04 95 328 A1 7/1992 European Pat. Off. .

05 78 021 A2 1/1994 European Pat. Off. .

05 97 523 A1 5/1994 European Pat. Off. .

WO 89/04583 5/1989 WIPO .

*Primary Examiner*—Huyen Lee

*Attorney, Agent, or Firm*—Sughrue, Mion, Zinn, Macpeak & Seas, PLLC

[57] ABSTRACT

A hearing aid includes a microphone (1), a signal-transmission unit (2, 3,) for forming or otherwise processing the signal, an output amplifier (4) to which an earphone (10) is connected, and a battery as the power supply. The output amplifier (4) is implemented essentially as a Σ-Δ amplifier and is connected to a pulse generator (8) which produces a high-frequency pulsed clock signal in the 1 MHz region. A series-connected low-pass filter (15) is also provided. The input signal to the signal converter is a representation, produced by signal processing in the transmission unit, of the low-frequency input signal to the hearing aid, this signal being converted in the signal converter into a binary signal. The output signal (14) thus appears, after passing through the low-pass filter, essentially as an amplified copy of the low-frequency input signal.

5 Claims, 3 Drawing Sheets

HEARING AID

BACKGROUND OF THE INVENTION

The invention relates to a hearing aid with a microphone, a transmission section for signal processing and an output amplifier with connected earphone.

Output amplifiers for hearing aids should have a low power consumption, even for a high output power, in addition to low distortion.

Class B amplifiers possess a higher efficiency than Class A amplifiers. Amplifiers of this type have also been usual for hearing aids in the past.

Output amplifiers in the form of switching amplifiers have an even better efficiency, since the losses in the switches can be theoretically zero.

Known switching amplifiers use pulse duration modulation.

Examples of such D amplifiers are disclosed and described in detail in the European patent application 0 590 903 A1 of Exar Corporation and in U.S. Pat. No. 5,247,581 of Exar Corporation as well as U.S. Pat. No. 4,689,819 and U.S. Pat. No. 4,592,087 of Industrial Research Products Inc., for example.

Such D amplifiers operate in principle as follows:

The square-wave pulse sequence of an oscillator in the ultrasonic frequency range is supplied to an integrator, to which the output voltage of a low-frequency signal is also supplied, whereby this signal arrives from a microphone via an amplifier arrangement and serves as a bias voltage. The output signal of the integrator is then a sawtooth pulse sequence, of which the zero crossings can be varied by the bias voltage in the audible frequency range that is supplied to the integrator. In other words, this low-frequency bias voltage variably shifts the zero crossings of the sawtooth signal from a characteristic which is symmetrical to the symmetry axis without bias voltage signal to an asymmetrical state, whereby the sign and magnitude of the asymmetry are a continuously changing function of the amplitude of the low-frequency input signal.

The zero crossings are then used to control the timing and polarity of the output signal of a polarity-reversing, symmetrical CMOS switching driver stage, which varies the duration of the positive and negative switching pulses corresponding to the time displacement between the zero crossings of the integrator output signal, and thus transmits a pulse-modulated output signal to the earphone with a frequency spectrum in the low-frequency range and which represents an amplified image of the output signal of the microphone.

Such D amplifiers operating with pulse duration modulation have a very high efficiency and operate with hardly any crossmodulation.

A disadvantage of D amplifiers with pulse duration modulation is that the pulse duration should be changed either continuously or in quite small steps if it is wished to achieve a high signal-to-noise ratio.

The known Class D output amplifiers use continuous modulation, i.e. continuous variation of the pulse duration, and therefore need a continuous output signal of the microphone as an input signal. If signal processing preceding the output amplifier takes place discretely with respect to time or amplitude, then this digital signal must first be converted, e.g. in a holding network or a digital-to-analog converter. This represents a hardly justifiable additional measure.

A sigma-delta converter is known from EP-A 0495328, for example, which is particularly suitable as an A/D converter with discrete components. Such circuits are, however, less suitable for use in hearing aids with highly integrated digital circuits.

In addition, EP-A0597523 discloses a fast D/A converter consisting of a sigma-delta converter and of a downstream asynchronous sigma-delta modulator which generates an ambivalent, asynchronously modulated signal from the output signal of the sigma-delta converter, said modulated signal being forwarded to a low-pass filter.

Here also, the level of complexity for the output amplifier of a fully digitized hearing aid is far too high. In addition, it is not possible to achieve a high signal-to-noise ratio.

A hearing aid is known from WO 89/04583 that consists of a part to be worn on the ear and a signal processing part connected via a cable to be worn on the body, in which digital signal processing is performed by means of an AID converter and fitting of the transmission function of the hearing aid to the hearing impairment of the wearer is realized by means of a downstream D/A converter.

The level of complexity here, particularly due to the use of an AID converter, a signal processor and a downstream D/A converter, is far too high and is unsuitable for a fully digitized hearing aid. In addition, an extremely high signal-to-noise ratio cannot be achieved with such a circuit.

Finally, EP-A 0578021 discloses a hearing aid that does not contain a sigma-delta converter but a normal AID converter, a signal processing circuit and a D/A converter.

These circuit parts are followed by a modulator which generates a PDM signal that has to be then forwarded to a low-pass filter. Here too, the level of complexity is too high, in addition to the fact that the use of normal analog-to-digital converters and a digital-to-analog converter following the signal processing circuit makes all the possible positive results of digital signal processing become quite illusory.

SUMMARY OF THE INVENTION

The invention therefore uses a completely different approach which avoids the need for the use of D/A converters of the normal type in the output amplifier of a fully digital hearing aid.

The aim of the invention is thus to propose a hearing aid with a novel, significantly simpler output amplifier in which a relatively high signal-to-noise ratio can be achieved, with an extremely low power requirement and high output power, with a minimum of distortion and a complete lack of crossmodulation as well as possible control of the output signal with a digital or analog input signal. The output amplifier can be designed completely as a digital highly integrated CMOS circuit for this purpose. This is realized by the invention by means of the characteristics of patent claim 1.

In accordance with the invention, a hearing aid includes a microphone (1), a signal-transmission unit (2, 3,) for forming or otherwise processing the signal, an output amplifier (4) to which an earphone (10) is connected, and a battery as the power supply. The output amplifier (4) is implemented essentially as a $\Sigma$-$\Delta$ amplifier and is connected to a pulse generator (8) which produces a high-frequency pulsed clock signal in the 1 MHz region. A series-connected low-pass filter (15) is also provided, although not necessarily as a separate electrical component. The input signal to the signal converter is a representation, produced by signal processing in the transmission unit, of the low-frequency input signal to the hearing aid, this signal being converted in the signal converter into a binary signal. The output signal (14) thus appears, after passing through the low-pass filter, essentially as an amplified copy of the low-frequency input signal.

The details of other characteristics of the invention are described in the other claims.

BRIEF DESCRIPTION OF THE DRAWINGS

The invention will now be described in more detail with reference to an example embodiment and in conjunction with the enclosed drawings, wherein.

DETAILED DESCRIPTION OF THE INVENTION

Figure 1:
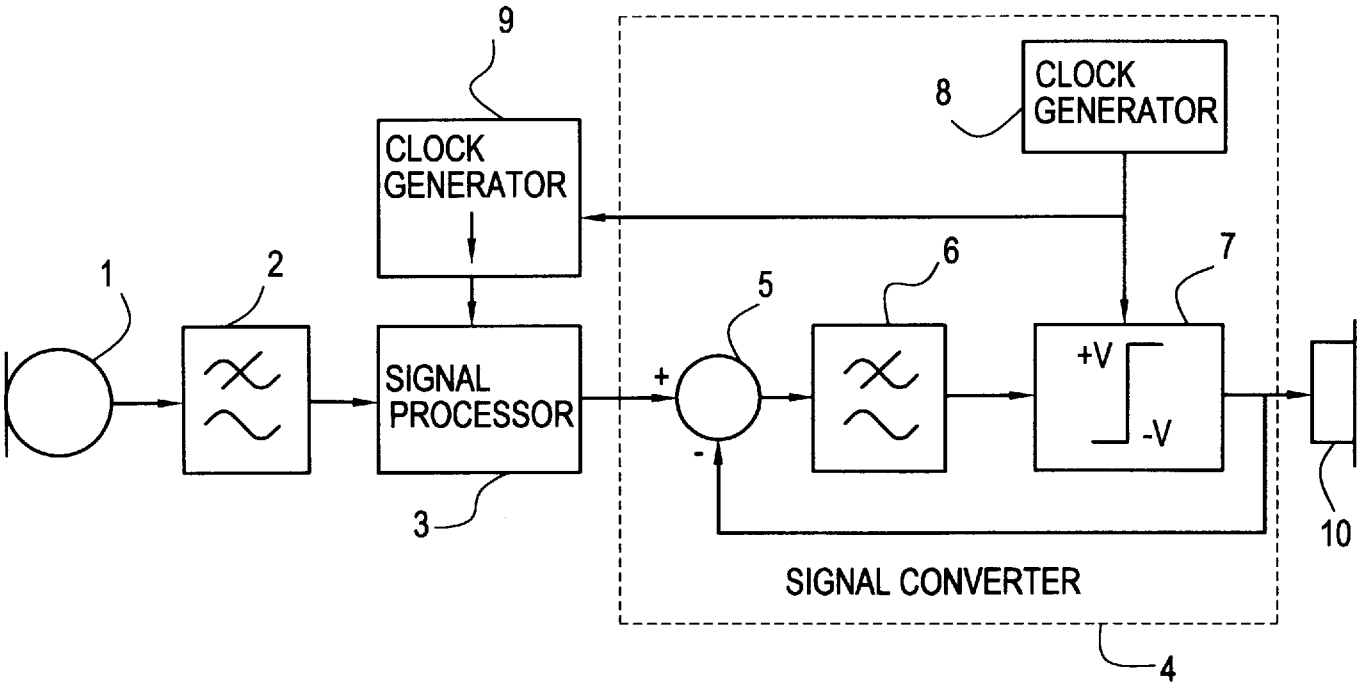
FIG. 1 shows a schematic diagram of a hearing aid with an output amplifier in accordance with the invention.

FIG. 1 shows for example a hearing aid with a novel output amplifier, whereby use of said amplifier is not restricted to use in hearing aids, however, but is generally applicable for digital amplifiers where a high ratio of useful signal to noise signal is required.

In the hearing aid shown purely schematically in FIG. 1, the acoustic signal is picked up by a microphone 1 and is limited to a frequency range usual for hearing aids in a low-pass filter functioning as an antialiasing filter. This low-frequency signal is then subjected to signal processing in a signal processor 3. This means, for example, that the analog input signal is further processed in analog form in such a way that the amplifier characteristic of the signal processor is adapted to the respective hearing impairment or hearing loss of the wearer with respect to all required variables.

Such frequency-dependent controllable variables include, for example, the gain of the individual stages, the limiting level, the compression threshold, automatic gain control with attack and release times, a combination of compression and expansion or a nonlinear characteristic of the gain of individual stages or of all stages, as well as the output sound pressure level.

On the other hand, a digital signal processing circuit will probably be preferred. In this case, the signal processor would have to be provided on the input side with an analog-to-digital converter, for which a separate clock generator would be required for the purpose of clock generation. This is the general state of the art. All the above described functions can then of course be realized in digital technology.

The signal processor 3 is then followed by a novel output amplifier. This essentially consists of a signal converter 4, which is essentially a Σ-Δ converter. This signal converter first contains a subtraction stage 5 with two inputs, namely a positive input and a negative input, whereby the positive input is connected to the output of the signal processor 3. This subtraction stage 5 is followed by a low-pass filter 6. In the simplest form, this low-pass filter could be an integrator 6' as shown in FIG. 3. A comparator stage 7 with holding network is connected to this filter 6. The output of this comparator stage is connected to the negative input of the subtraction stage 5 by means of a feedback loop. In addition, a high-frequency clock generator 8 is provided which outputs a high-frequency clock pulse signal with a frequency in the range of around 1 MHz to the comparator stage 7. The output of the signal converter 4 is connected to the earphone 10 by means of a low-pass function.

A clock generator 9 with a significantly lower frequency required for the signal processor 3 is preferably synchronized by the high-frequency clock generator. This can be achieved, for example, in a simple way by frequency division by a factor M. A typical clock frequency for the signal processor 3 could be around 32 kHz.

Figure 2:
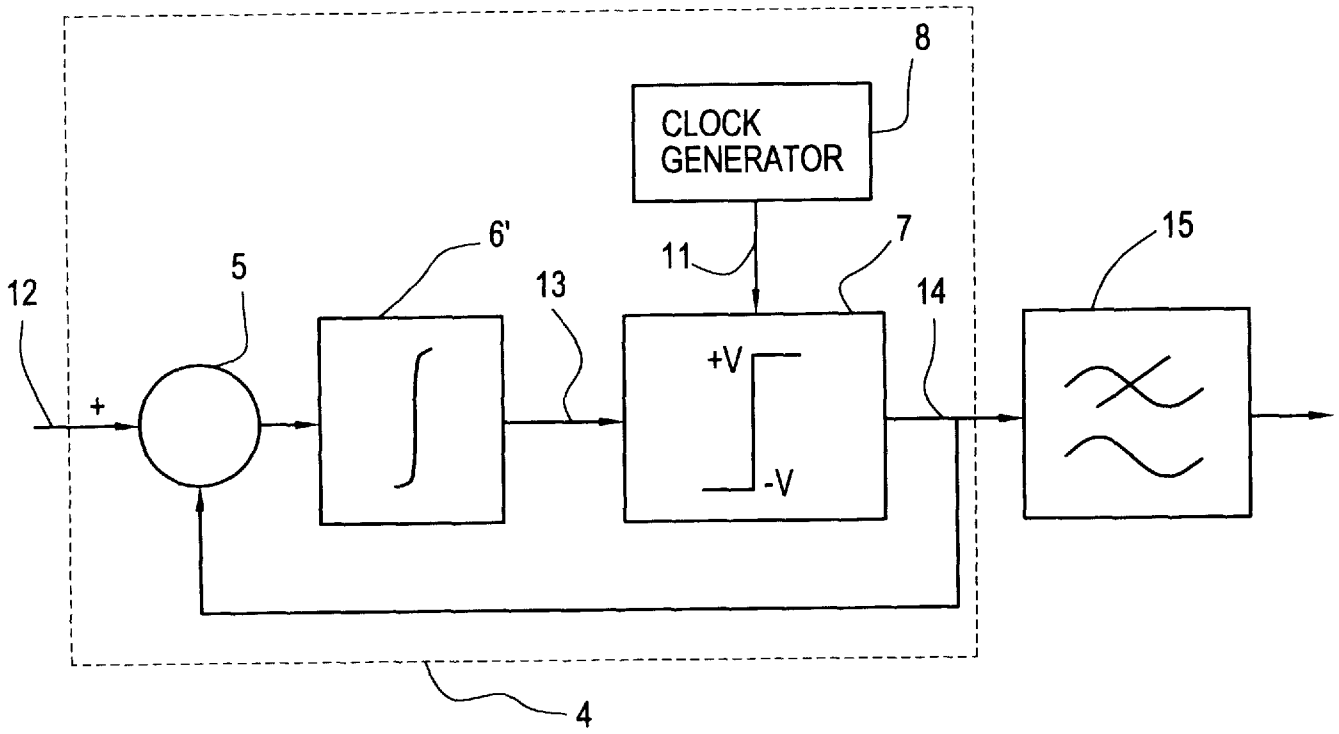
FIG. 2 shows a signal converter used in the output amplifier of the hearing aid and FIG. 3 pulse diagrams for explanation of the mode of operation of the output amplifier of the hearing aid.
Figure 3A:
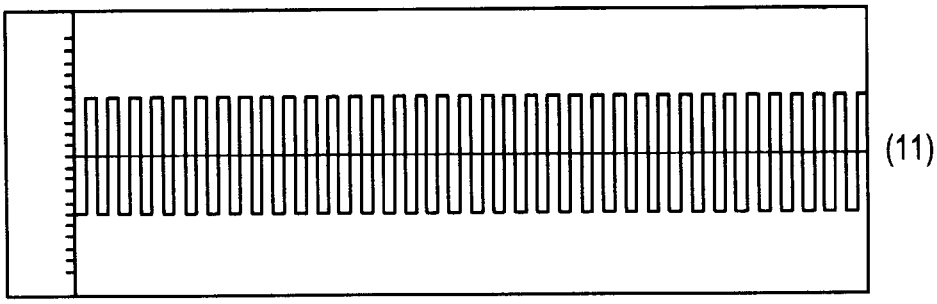
Figure 3B:
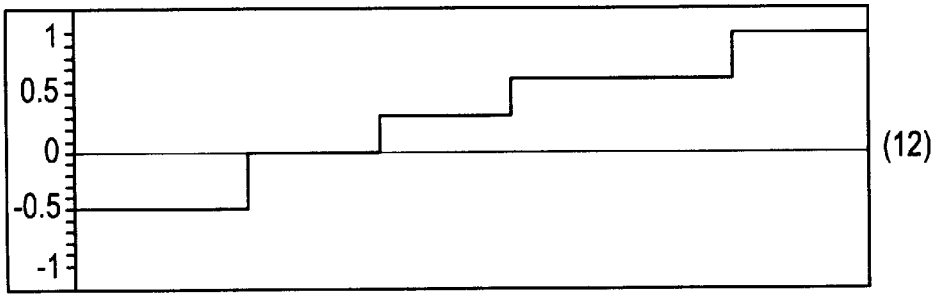
Figure 3C:
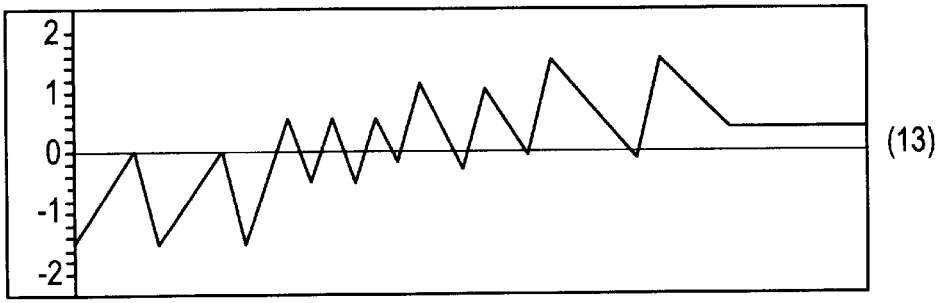
Figure 3D:
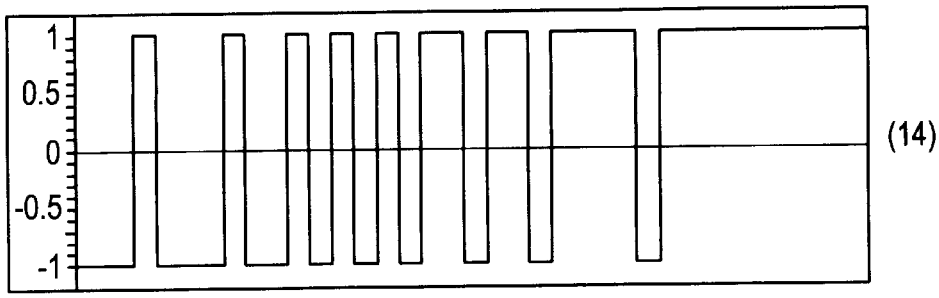

The mode of operation of the signal converter 4 will be explained with reference to FIGS. 2 and 3.

The high-frequency clock signal 11 of the clock generator 8 is supplied to the comparator stage 7, as already mentioned above. The digital input signal 12 in FIG. 3 (an extremely simplified representation) is supplied to the positive input of the subtraction stage. The output signal 14 of the signal converter 4 is supplied to the negative input of the subtraction stage via a feedback loop and is subtracted there from the input signal 12.

The resultant output signal is supplied to the integrator 6'(which represents the low-pass filter here) and is integrated there to produce the output signal 13. This signal 13 is converted into the output signal 14 in the comparator stage 7 with holding network synchronously with the edges of the high-frequency clock signal, whereby the output signal can have only two possible values, which are represented here as +1 and −1 for simplicity's sake.

Let the input signal 12 initially have the value −0.5. The integrated signal 13 then increases from −1.5 to zero, and this results in a first output pulse transition from −1 to +1. The integrated signal then drops to −1.5 again, after which the output signal 14 again assumes the value −1.

The subsequent rise of the input signal 12 to the value zero results in a steeper rise of the integrated signal 13 to the value 0,5. The corresponding signal values of the output signal 14 between −1 and +1 are then obtained for the duration of the input signal level 0 by way of integration, whereby the values −1 correspond to the lower value of the integrated signal and the values +1 to the upper value of the integrated signal.

In the same way, the other values of the input signal of 0.3, 0.6 and 1.0 are converted into corresponding pulses of the output signal 14 by way of integration. In other words, the relationship of positive values to negative values per unit of time in the output signal 14 changes as a function of input signal 12.

It is quite obvious that this is a very highly simplified and greatly expanded representation. It would not be possible to represent a clock frequency of around 1 MHz in drawing form. In addition, the amplitude changes are shown in extremely simplified form as rough steps.

The analog signal is quantized when a low-frequency analog signal is converted into a digital signal by time-discrete and/or amplitude-discrete conversion. The steps of the input signal 12 shown in FIG. 3 therefore represent corresponding amplitude steps of a quantized analog signal.

Whereas clock pulse frequencies of 100 kHz are normally sufficient for pulse duration modulation of the standard type, significantly higher clock pulse frequencies are required in the present case in order to obtain a large ratio between the useful signal and the noise signal, whereby these may lie in the range of 1 MHz.

It is apparent that in addition to the desired low-frequency component, the output signal 14 of the signal converter 4 also contains a strong high-frequency signal component, which is naturally an undesirable interference signal and which has to be removed, for example by a passive low-pass filter 15.

If this output amplifier is used in a hearing aid, then the inductance of the oscillating coil of the earphone and the low-pass characteristics of the mechanical and acoustic system of the hearing aid and of the human ear can fully perform this low-pass function so that a separate low-pass filter appears dispensable.

This novel output amplifier which is particularly suitable for hearing aids has a number of advantages. All pulse edges are synchronized with a known clock pulse frequency, which can also be used to synchronize the clock pulse generator required for the upstream signal processor operating at a significantly lower clock frequency.

In addition, the input signal of the output amplifier can be a digital signal and the output amplifier designed as a pure digital circuit. This means, however, that the whole circuit can be designed as a digital circuit, whereby an analog-to-digital converter would have to be provided only at the input of the signal processor 3. This results in the further possibility of designing the whole circuit as a highly integrated circuit in C-MOS technology.

I claim:

1. A hearing aid having a microphone (1) for receiving an analog input signal representing sound, a transmission section (2, 3) coupled to said microphone for signal processing, an earphone (10) for reproducing sound, and an output amplifier (4) connected between said transmission section and said earphone, said amplifier comprising a signal converter realized as a switching converter, with a clock generator (8) connected thereto for generating a high frequency clock pulse signal, said hearing aid further including a low-pass filter (15) at a downstream side of said amplifier, as well as a battery for supplying power to the hearing aid, characterized in that the signal converter (4) comprises only a single Σ-Δ converter, which is a synchronous converter, and that an input signal of the signal converter is a digital representation of said analog input signal consisting of a sequence of bits, so that said input signal can be converted in the signal converter into an output signal (14) that has only two possible signal values, said output signal, after passing through said low-pass filter (15), appearing as an amplified low frequency representation of the input signal to the hearing aid.

2. A hearing aid in accordance with claim 1 characterized in that the signal converter (4) has an input connected to an output of the transmission section, said signal converter comprising a subtraction stage (5) having a positive and a negative input, a low-pass filter (6) and a comparator circuit (7) with holding network controlled by said clock pulse generator (8), the positive input of the subtraction stage being connected to the output of the transmission section (2, 3), whereas the negative input of the subtraction stage (5) is connected to the output of the comparator stage (7) by way of a feedback loop.

3. A hearing aid in accordance with claim 1, characterized in that a clock frequency of the clock pulse signal generated by the clock generator (8) lies in the range of 1 MHz.

4. A hearing aid in accordance with claim 1 further comprising a further clock signal generator (9) generating a clock pulse signal for controlling the signal processor (3), said further clock signal generator being synchronized by said high frequency clock pulse signal (11).

5. A hearing aid in accordance with claim 1, characterized in that the low-pass filter is realized by the electrical, acoustic and mechanical characteristics of at least one of the earphone (10) and the human ear.

* * * * *